US005167306A

United States Patent [19]

Carrigan, Jr.

[11] Patent Number: 5,167,306

[45] Date of Patent: Dec. 1, 1992

[54] LUGGAGE WITH CART APPARATUS

[75] Inventor: Richard M. Carrigan, Jr., Evanston, Ill.

[73] Assignee: United Wire Craft, Inc., Chicago, Ill.

[21] Appl. No.: 859,156

[22] Filed: Mar. 27, 1992

[51] Int. Cl.[5] ..... A45C 5/14

[52] U.S. Cl. ..... 190/18 A; 190/115

[58] Field of Search ..... 190/18 A, 39, 115; 280/47.26, 47.315, 47.371, 37

[56] References Cited

U.S. PATENT DOCUMENTS

| | | | |
|---|---|---|---|
| 2,472,491 | 6/1949 | Quinton | 280/37 |
| 2,795,433 | 6/1957 | Moriarty | 280/47.28 |
| 3,540,752 | 11/1970 | Anuskiewicz | 280/47.371 |
| 3,917,038 | 11/1975 | Foge et al. | 190/18 A |
| 4,175,769 | 11/1979 | Kazmark | 280/654 |
| 4,228,877 | 10/1980 | Cothary | 190/18 A |
| 4,275,894 | 6/1981 | Mortenson | 280/5.24 |
| 4,286,796 | 9/1981 | Esposito | 280/47.27 |
| 4,523,773 | 6/1985 | Holtz | 280/654 |
| 4,546,995 | 10/1985 | Kassai | 280/655 |
| 4,588,055 | 5/1986 | Chen | 190/115 |
| 4,621,404 | 11/1986 | Browning | 190/18 A |
| 4,759,431 | 7/1988 | King et al. | 190/115 |
| 4,784,405 | 11/1988 | Stein | 280/655 |
| 4,890,705 | 1/1990 | Pineda | 190/18 A |
| 4,995,487 | 2/1991 | Plath | 190/18 A |
| 5,002,304 | 3/1991 | Carrigan, Jr. | 280/655 |
| 5,108,119 | 4/1992 | Huang | 190/18 A |

FOREIGN PATENT DOCUMENTS 2040236 8/1980 United Kingdom .

*Primary Examiner*—Gary E. Elkins

*Attorney, Agent, or Firm*—Fitch, Even, Tabin & Flannery

[57] ABSTRACT

Combined luggage and cart apparatus includes a cart disposed within a luggage case. The cart has tubular legs joined at one end by a base plate. A U-shaped handle is inserted in the legs and a locking arrangement prevents separation of the handle from the legs, once inserted. The locking arrangement includes a sleeve inserted in the legs, and a split ring insertable through the sleeve and held captive on the handle. The sleeve includes a locking tab to engage the legs, and the split ring engages the sleeve when the handle is placed in use.

15 Claims, 3 Drawing Sheets 82
42
10
12
34
18
20.22
26
74

42
82
80
80
94
12
120
52
100
52
18
24
48
42
14
60
58
66
30
66

12
14
18
16
28
100
52
120
52
22
48
24
20
74
64
66
64
66

10
82
80
110
44
94
92
90
42
18
52
106
120
28
12
50
48
58
14
62
40
24
56
60
30
74
66
26

122
100
108
112
86
88

LUGGAGE WITH CART APPARATUS

BACKGROUND OF THE INVENTION

1. Field of the Invention

The present invention pertains to luggage and carts used with luggage, and in particular pertains to luggage having carts incorporated therewith.

2. Description of the Related Art

Commonly assigned U.S. Pat. No. 5,002,304 discloses a collapsible cart which has been received with immediate interest by people who need to carry relatively large, heavy items such as suitcases, computers and electronic repair equipment used with photocopy machines, computers and typewriters, for example. The cart is conveniently stored when not in use, having the ability to be quickly and easily collapsed. Luggage manufacturers have sometimes incorporated a cart into an item of luggage, with the cart providing a supporting framework for the luggage. Rigid structures such as steamer trucks, which do not use a cart, are sometimes provided with wheels which eliminate the need to lift the trunk off of the ground when being transported. Other arrangements have been provided in which roller features have been made available for smaller items of luggage.

SUMMARY OF THE INVENTION

It is an object according to the present invention to provide a luggage and cart apparatus in which a cart is incorporated within an item of luggage and is, in effect, dedicated for use with that luggage item.

Another object according to the present invention is to provide luggage and cart apparatus of the above type where the luggage item is soft-sided, being made of a flexible fabric construction.

Another object according to the present invention is to provide an economical construction for luggage and cart apparatus of the above-described type, which is made form a minimum number of inexpensive parts, and which is readily assembled with a minimum of labor.

Yet another object according to the present invention is to provide luggage and cart apparatus, in which the cart has a retractable handle which may be stowed within the outline of the luggage item, when the cart features are not required.

These and other objects according to the present invention which will become apparent from studying the appended description and drawings are provided in a suitcase apparatus having an outer flexible hollow body defining a substantially enclosed interior, and a cart for supporting the body, the cart comprising:

- a pair of spaced hollow tubular frame-legs each having a base-end and a handle-end, with at least major portions of the frame-legs disposed within the flexible hollow body;
- a base bridging the frame-legs, joined to the base-ends thereof;
- roller means attached to the base, with portions of the hollow body between the base and roller means;
- handle means for supporting the apparatus extending between the frame-legs and having enlarged leg-engaging ends telescopically engaged with the handle-ends of said frame-legs; and
- locking means including handle-engaging means on said frame-legs and leg-engaging means on said handle means cooperating together to maintain telescopic engagement with the handle means and the frame-legs, despite pulling forces applied to said handle means in a direction away from said frame-legs, one of said leg-engaging means and said handle-engaging means including a locking socket means for locking the other of said leg-engaging means and said handle-engaging means and defining a through-bore for receiving the other of said leg-engaging means and said handle-engaging means.

DETAILED DESCRIPTION OF THE PREFERRED EMBODIMENT

Figure 1:
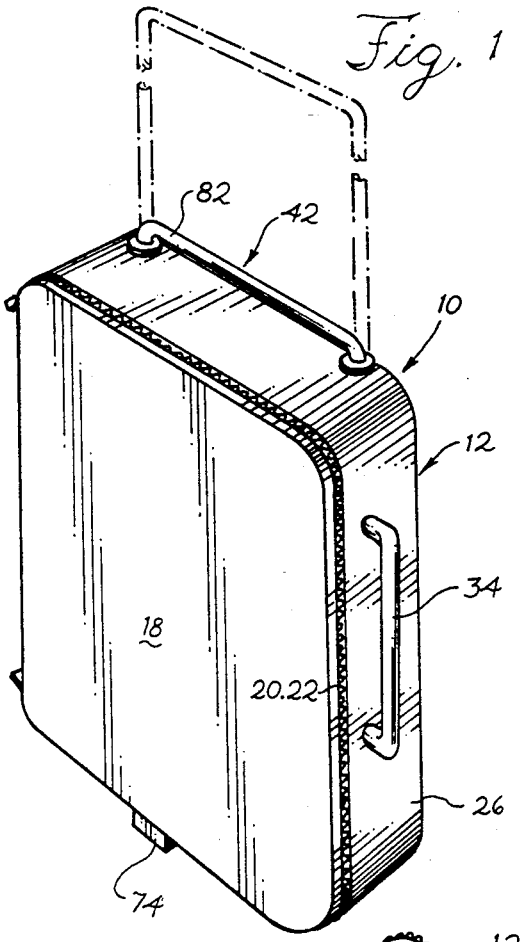
FIG. 1 is a perspective of luggage and cart apparatus constructed according to principles of the present invention.
Figure 2:
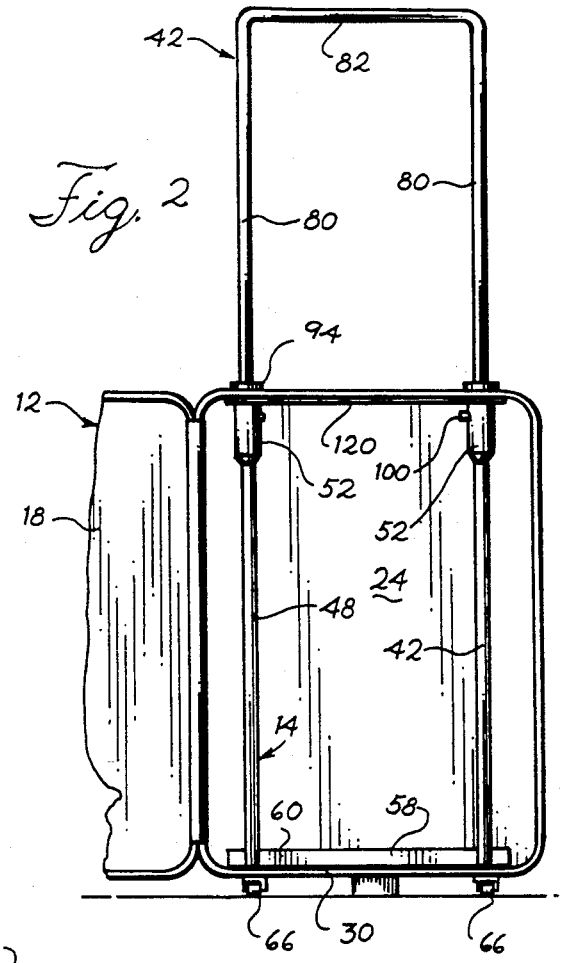
FIG. 2 is a fragmentary front elevation view thereof, showing the luggage case in an open position.

Referring now to the drawings, FIG. 1 shows luggage and cart apparatus, generally indicated at 10. Apparatus 10 comprises an integral assembly of luggage and cart components, including a flexible hollow body or luggage case generally indicated at 12 and a cart generally indicated at 14 (see FIG. 2). Apparatus 10 is shown with a luggage case 12 of the soft-sided flexible fabric type, although the cart 14 could be used with rigid hard-shell luggage cases and packing and shipping cases which are known and are presently in use. As will be appreciated by those skilled in the art, a soft-sided luggage case, such as that illustrated in the drawings presents a unique demand on the luggage cart since the luggage case does not have a self-supporting body of the type which can support significant cantilever forces, such as those encountered when using an extended handle to direct and pull the apparatus.

Figure 3:
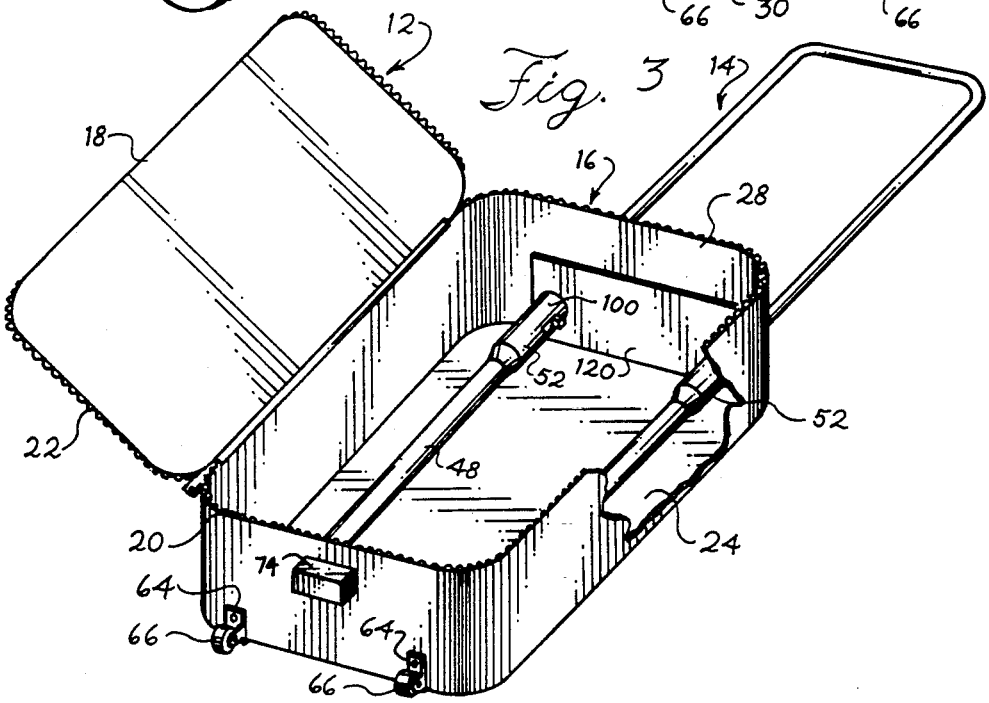
FIG. 3 is perspective view thereof shown partly broken away.

Referring additionally to FIG. 3, the luggage case 12 includes a tray-like body generally indicated at 16 and a generally flat, planar cover 18. The body 16 and cover 18 are joined together by mating zipper tracks 20, 22, respectively. The body 16 includes a major wall 24 located opposite cover 18, and a continuous sidewall 26 having a top portion 28 and a bottom portion 30. The luggage case 12 of the preferred embodiment, as mentioned above, is of a so-called "soft-sided" type with cover 18 and wall 24 comprising essentially, fabric panels and the sidewall comprising fabric-covered paperboard. If desired, a conventional handle such as molded plastic handle 34 may be attached to sidewall 26 in a conventional manner, as shown in FIG. 1. As will be appreciated by those skilled in the art, the luggage case 12 as described herein may comprise any one of a number of conventional constructions carefully constructed to be self-supporting when carried by handle 34 illustrated in FIG. 1. As will be seen herein, the cart constructed according to principles of the present invention provides economic advantages to a luggage or cart manufacturer and may be adapted for retrofit assembly with existing luggage cases. The cart according to the present invention is preferably enclosed within the luggage case in such a manner that a minimum volume within the case is lost by addition of the cart. Further, the cart of the present invention strengthens the luggage case in general, and especially when apparatus 10 is fully loaded and rolled along a walkway using the extended handle of the cart.

Figures 4, 5, 6:
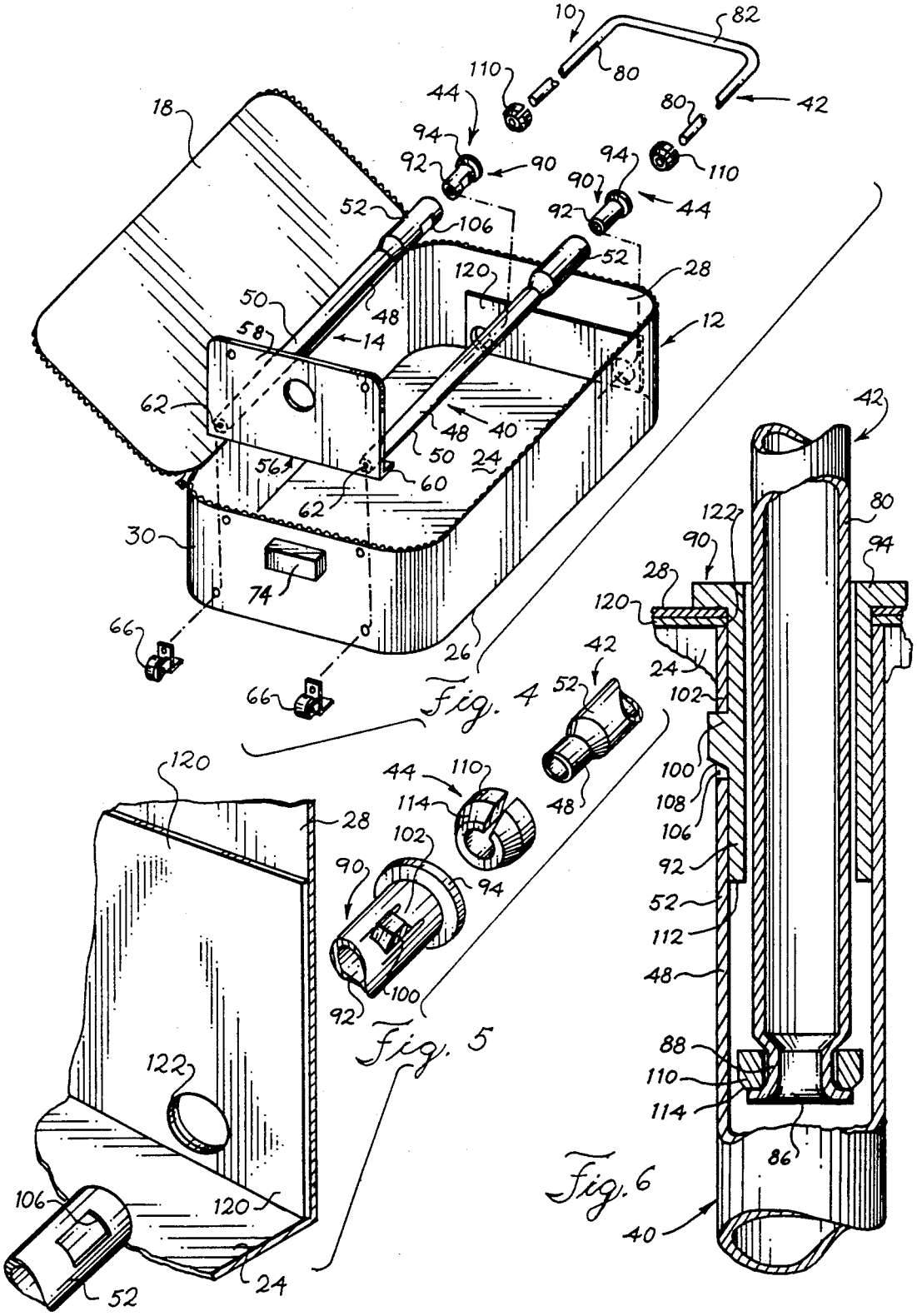
FIG. 4 is an exploded perspective view thereof.
FIG. 5 is a fragmentary perspective view thereof shown on an enlarged scale.
FIG. 6 is a fragmentary front elevational cross-sectional view of the components of FIG. 5 shown in a fully assembled condition.

Referring now to FIGS. 3 and 4, and especially to FIG. 4, cart 14 includes a frame generally indicated at 40, a handle generally indicated at 42 and a pair of lock arrangements generally indicated 44. The frame 40 is preferably of welded construction and includes a pair of hollow, tubular cart legs 48 having base ends 50 and handle ends 52. In the preferred embodiment, the handle ends 52 are enlarged to accommodate certain elements of the lock arrangements 44, although the legs 48 could be of generally constant cross-sectional size throughout their length. The ends 50 of legs 48 are joined to a base 56, which bridges the legs and is joined thereto by welding or other conventional means of attachment. In the preferred embodiment, the base 56 includes a major T-shaped wall 58 with a minor wall 60 extending therefrom at a generally right angle, extending generally in the direction of legs 48.

Base wall 58 includes apertures 62 for receiving fasteners 64 (see FIG. 3) which secure rollers 66 to apparatus 10. Apertures 70 formed in base wall 58 receive fasteners for securing a cushion support 74 of rubber or plastic material, for example, to apparatus 10. As can be seen in FIG. 4, apertures are provided in the bottom portion 30 of sidewall 26 for receiving the fasteners 64, 72, whereby rollers 66, 74 are secured to base 56.

The handle 42 is of generally U-shaped construction, having handle legs 80 and an intermediate manually graspable bight portion 82. Referring additionally to FIG. 6, the handle legs 80 have leg-engaging free ends 86 which are swaged to form an optional concave annular recess 88, for use in a locking arrangement 44 as will be described herein. As can be seen in FIG. 6, the legs of handle 42 are sized for telescopic insertion within the frame legs 48 to allow the handle 42 to be stored generally within the outline of the luggage case 12, as can be seen in FIG. 1.

The lock arrangement 44 includes a socket or sleeve 90, preferably of molded plastic construction, having a generally cylindrical body 92 and a flange 94. As can be seen in FIG. 5, a locking post 100 extends above the surface of the body portion 92 and is mounted at the free end of a cantilever tongue 102 formed in the upper portion of body 92, so as to be resiliently deflectable in an inward direction. As shown in FIG. 6, the locking post 100 is receivable in a portal or window 106 formed in the frame leg. The locking post 108 preferably includes an optional bevelled edge 108 which cams against the free end of frame leg 48, causing inward deflection of the locking post, allowing the post to be compressed within the frame leg. With continued insertion in the frame leg, the locking post 108 enters window 106 where it is free to be released in an outward direction under the resilient bias force provided by tongue 102. As shown in FIG. 6, the locking post 100 extends beyond frame leg 48, preventing withdrawal from the frame leg.

The locking arrangement 44 further includes collars 110 located in recess 88 of the handle legs 80. The collars 110 are preferably split so as to have spaced free ends, which may be brought together when the collar is compressed. The collars have outside diameters larger than the inner diameter of sleeves 90, so that they contact the bottom free ends 112 of the sleeves (see FIG. 6). As can be seen in FIG. 5, the collars 110 have an optional bevelled surface 114 which, with reference to its installed position on handle 42, faces away from bight portion 82. When received in recesses 88 of the handle legs, collars 110 in effect provide enlarged free ends for the handles which interfere with sleeves 90 to lock the handles captive within the frame legs, in the manner illustrated in FIG. 6.

A number of alternative assembly procedures are possible with apparatus constructed according to the present invention. For example, the sleeves 90 can be telescopically inserted in the enlarged handle ends 52 of frame legs 48, with the collars 110 attached to the handle legs 80 and then inserted through the inner bore of sleeves 90. The bevelled surfaces 114 of the split collar aid in such insertion, with the gap in the split collar closing to permit the telescopic insertion. Thus, in effect, with this mode of installation the handle legs are provided with resiliently collapsible enlarged free ends.

The split rings 100 can be inserted through sleeves 90, prior to insertion of the assembly in the frame legs. As a further alternative, sleeves 90 can be telescopically inserted over the handle legs 80, before either the swaging operation (to produce annular recess 88) or the installation of the collars is performed.

The present invention also contemplates enlarging the free ends of handle legs 80 with flaring or the like tooling operation, to assume a diameter greater than the inner bore size of sleeves 90. The sleeves may or may not be used. If used, they can be telescopically inserted over the handle legs prior to such enlargement of the handle free ends, and the assembly thereafter telescopically inserted in frame legs 48. If desired, one or more longitudinal slits can be formed at the flared free ends of handle legs 80 before or after flaring, to provide a resilience for clearing the inner bore of sleeves 90. In this last mentioned alternative embodiment, the resilience of the handle leg material can be relied upon to expand the slit free ends of the handle legs after they travel through sleeve 90. If desired, an elastomeric insert can be provided at the free end of the handle legs to guarantee expansion of the slit free ends. In such embodiments, the swaging operation or other means of forming annual recess 88 and the collar 110 are not required and may be omitted, if desired.

It can now be seen that apparatus according to principles of the present invention provides several alternative methods of construction, to achieve locking of the handle legs within the frame legs. This locking engagement is important when the handle 42 is fully extended, and a pulling force is applied to the handle, as may occur for example, when the apparatus is lifted over a street curb or up a flight of stairs. It is important in such circumstances that the handle not be separated from the frame legs and the various arrangements described above provide the assured interlocking needed.

Referring to FIGS. 4–6, a backing plate 120 is located in the interior of luggage case 12, being pressed against the top portion 28 of sidewall 26. As can be seen in the upper portion of FIG. 6, and in FIG. 5, backing plate 120 is provided with apertures 122 for receiving sleeve 90. It is generally preferred that the backing plate 122 overlie the free end of frame leg 48 so as to reduce pressure on molded plastic flange 94. The base wall 58 provides a somewhat similar advantage in providing a backing for the lower portion 30 of sidewall 26. As mentioned above, the base wall 58 provides mounting for rollers 66, 74. The base 56 and backing plate 120 are preferably made of metal, but could also be made of a rigid, relatively dense material compared to the fabric material of luggage case 12. For example, base 56 and backing plate 120 could be made from a plastic, fiberboard or fiberglass composite. If desired, the frame 40 and/or handle 42 could be made from similar non-metallic materials.

Figure 7:
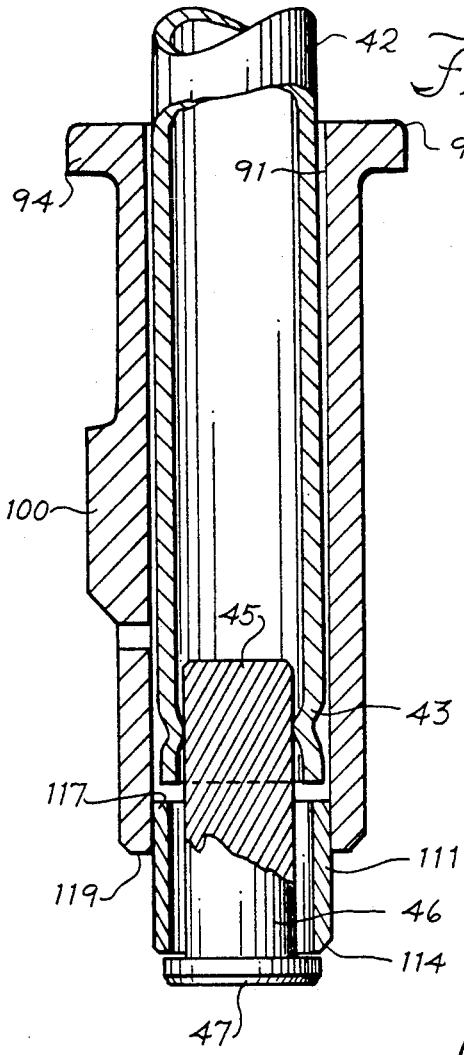
FIG. 7 is a fragmentary cross-sectional view similar to that of FIG. 6, but showing an alternative embodiment of apparatus according to principles of the present invention.
Figure 8:
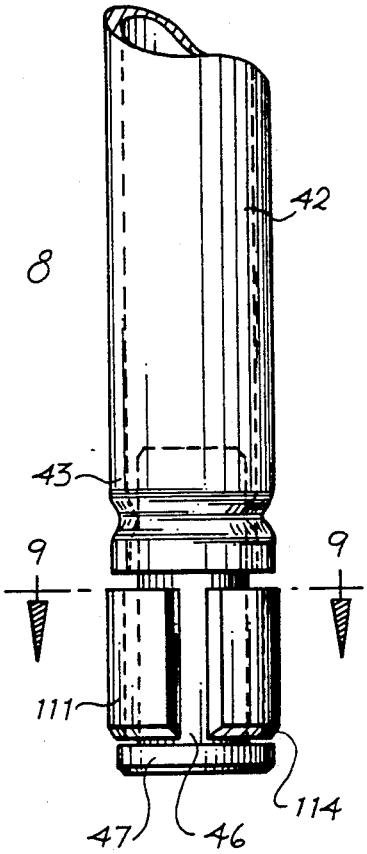
FIG. 8 is a fragmentary elevational view of FIG. 7, but omitting the outer sleeve 90 of FIG. 6.
Figure 9:
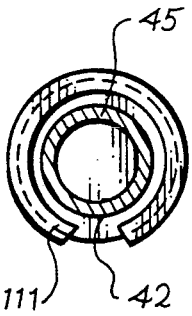
FIG. 9 is a cross-sectional view taken along the line 9—9 of FIG. 8.
Figure 10:
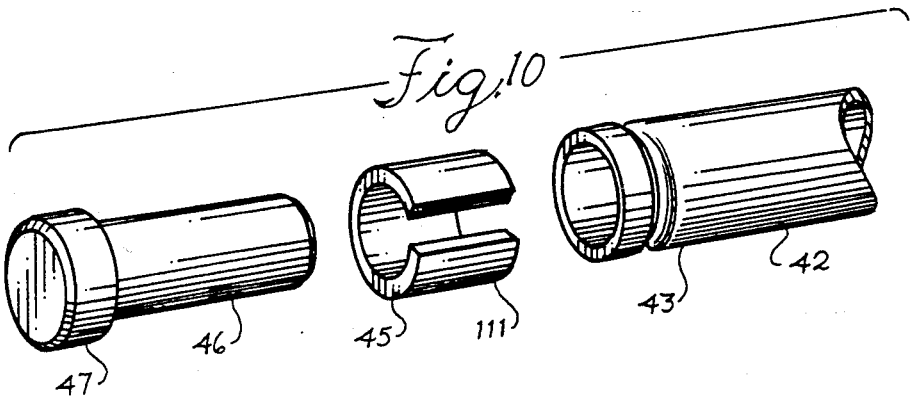
FIG. 10 is an exploded view of the assembly illustrated in FIG. 8.

Referring now to FIGS. 7–10, an alternative embodiment of the lock arrangement will be described. FIG. 7 shows handle 42 having a free end 43. A pin 46 having an enlarged head 47 and an opposed free end 45 extends from the handle free end 43. The end 45 of pin 46 is received in the free end of the hollow tubular handle 42 and is secured thereto with conventional means, such as crimping as shown in FIG. 7, swaging, welding, adhesives or the like. As can be seen in FIG. 7, substantial portions of pine 46 extend beyond the free end 43 of the handle. The enlarged head 47 of the pin preferably has an outer diameter slightly larger than that of the handle free end 43, although the enlarged head could be dimensioned smaller, if desired. A split collar 111 having a bevelled end 115 is disposed about pin 46, being held captive between the enlarged head 47 and the handle free end 43, as shown in FIG. 7.

Referring again to FIG. 7, sleeve 90 has an inner bore 91, which is tapered, having an enlarged end adjacent flange 94. The split collar 91 has a bevelled end 115, which preferably is dimensioned larger than inner bore 91 and is split in the manner described above so as to be resiliently compressible. With sleeve 90 locked in the frame handle by post 100, the frame-engaging ends of handle 42 are thrust into sleeves 90, compressing the locking collars 111. As insertion of the frame-engaging ends of the handle is continued, the locking collars 111 are increasingly compressed due to the taper of the sleeve inner bore. Compression of the split collar is greatest at the point of insertion illustrated in FIG. 7, immediately before a point in time where the split collar is pushed completely through sleeve 90, and allowed to expand such that the upper end 117 of the split collar is allowed to enlarge to its original diameter, for abutting engagement with the annular face 119 of sleeve 90. With the assembly of FIGS. 7–10, the distance between the enlarged head 47 of pin 46 and the free end 43 of handle 42 can be accurately controlled, despite changes in the longitudinal dimension of handle 42 occasioned by working the handle material in a swaging or other metal-forming operation. The arrangement of FIGS. 7–10 also provides an enlarged free end for handle 42 which provides assured retention of the split collar, despite forces applied to the handle by a user, which would otherwise cause the handle to be withdrawn either fully or partially through sleeve 90.

Although various arrangements for enlarging tubular ends have been described with respect to handle 42, the locking arrangements of the handle and frame legs could be interchanged with the frame legs having any of the various enlarging arrangements such as pin 46, described above, and being dimensioned for reception within the free ends of the handle legs 80. In either event, the locking means described herein are employed to prevent separation of the handle legs and frame legs as the handle is extended to an operating position, and is used to pull the suitcase apparatus from one location to another.

The drawings and the foregoing descriptions are not intended to represent the only formed of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A suitcase apparatus having an outer flexible hollow body defining a substantially enclosed interior, and a cart for supporting the body, the cart comprising:

a pair of spaced hollow tubular frame-legs each having a base-end and a handle-end, with at least major portions of the frame-legs disposed within the flexible hollow body;

a base bridging the frame-legs, joined to the base-ends thereof;

roller means attached to the base, with portions of the hollow body between the base and roller means;

handle means for supporting the apparatus extending between the frame-legs and having enlarged leg-engaging ends telescopically engaged with the handle-ends of said frame-legs; and locking means including handle-engaging means on said frame-legs and leg-engaging means on said handle means cooperating together to maintain telescopic engagement with the handle means and the frame-legs, despite pulling forces applied to said handle means in a direction away from said frame-legs, one of said leg-engaging means and said handle-engaging means including a locking socket means for locking the other of said leg-engaging means and said handle-engaging means and defining a through-bore for receiving the other of said leg-engaging means and said handle-engaging means.

2. The apparatus of claim 1 wherein said leg-engaging means includes a pair of collars on said handle means adjacent the leg-engaging ends thereof.

3. The apparatus of claim 2 wherein said handle-ends define annular recesses for receiving said collars.

4. The apparatus of claim 2 wherein said collars are split to form a pair of opposed spaced apart free ends, and are compressed so as to bring the free ends toward one another when inserted in the frame-legs.

5. The apparatus of claim 4 wherein said collars have bevelled ends facing toward said frame-legs, to aid in insertion in the frame-legs.

6. The apparatus of claim 5 wherein said locking socket means comprises sleeve means dimensioned to be received in said handle-ends of said frame-legs and defining a central bore for receiving said handle-legs, said collars dimensioned larger than the central bore so as to prohibit passage of said collars through the entirety of said sleeve means.

7. The apparatus of claim 6 wherein the central bore of said sleeve means is double-ended and tapered to form a larger end facing the handle means.

8. The apparatus of claim 7 wherein said sleeve means includes an outwardly protruding locking post resiliently deflectable away from the sleeve means central bore, and said handle-ends of said frame-legs to define a portal for receiving said locking posts.

9. The apparatus of claim 7 wherein said handle means includes hollow ends and said handle means further comprises pin members at least partly received in said hollow ends, said pin members having enlarged heads cooperating with said handle means to form said enlarged leg-engaging ends.

10. The apparatus of claim 1 wherein said locking means further comprises sleeve means dimensioned to be received in said handle-ends of said frame-legs and defining a central bore for receiving said handle-legs.

11. The apparatus of claim 10 wherein said sleeve means includes an outwardly protruding locking post resiliently deflectable away from the sleeve means central bore, and said handle-ends of said frame-legs define a portal for receiving said locking posts.

12. The apparatus of claim 11 wherein said sleeve means includes an arm of resilient material carrying said locking post.

13. The apparatus of claim 12 wherein said arm is cantilevered from said sleeve means and has a free end carrying said locking post.

14. The apparatus of claim 1 wherein said base is generally T-shaped, with the head of the T-shape attached to said frame-legs and the stem of the T-shape including means for mounting at least some of said roller means.

15. The apparatus of claim 1 further comprising a backing plate more rigid than the hollow body and defining apertures for receiving said handle-ends.

* * * * *

UNITED STATES PATENT AND TRADEMARK OFFICE

CERTIFICATE OF CORRECTION

PATENT NO. : 5,167,306

DATED : December 1, 1992

INVENTOR(S) :

Carrigan, Jr.

It is certified that error appears in the above-indentified patent and that said Letters Patent is hereby corrected as shown below:

Column 1, line 40, change "form" to --from--.

Column 5, line 12, after "66" insert --and support--.

Column 5, line 54, after "face" insert --of the bevelled end--.

column 6, line 11, change "formed" to --forms--.

Signed and Sealed this

Twenty-eighth Day of June, 1994

*Attest:*

Bruce Lehman

BRUCE LEHMAN

*Attesting Officer*

*Commissioner of Patents and Trademarks*